United States Patent [19]

Gay

[11] 4,452,036

[45] Jun. 5, 1984

[54] METAL BRACELET IN THE FORM OF A BAND COMPRISED OF MEMBERS LINKED ONE WITH RESPECT TO THE OTHER

[75] Inventor: Jean-Pierre Gay, Presinge, Switzerland

[73] Assignee: Gay Freres, S.A., Geneva, Switzerland

[21] Appl. No.: 447,661

[22] Filed: Dec. 7, 1982

[30] Foreign Application Priority Data

Feb. 3, 1982 [CH] Switzerland ..... 652/82

[51] Int. Cl.[3] ..... F16G 13/00

[52] U.S. Cl. ..... 59/80; 63/4; 59/82

[58] Field of Search ..... 59/78, 80, 82, 84, 87, 59/88, 90, 91, 79.3; 63/3, 4; D11/3, 12, 19

[56] References Cited

U.S. PATENT DOCUMENTS 1,120,961 12/1914 Morse ..... D11/18
4,353,459 10/1982 Petershack ..... 59/91

FOREIGN PATENT DOCUMENTS 1137609 10/1962 Fed. Rep. of Germany ..... 59/78
1216963 12/1970 United Kingdom ..... 59/80

*Primary Examiner*—Daniel C. Crane
*Assistant Examiner*—David B. Jones
*Attorney, Agent, or Firm*—Birch, Stewart, Kolasch & Birch

[57] ABSTRACT

The bracelet is constituted by members of general U shape (1 to 5), with the same internal profile, engaged in staggered manner one in the other, the sides (*2a,5a*) comprising, on their inner face, a groove (*6a,7b*) together defining a passage for a pin (10) of corresponding shape, in particular circular shape. The clearance (13,18) between two adjacent members of the same row is less than the necessary movement of the members perpendicular to the pins for releasing it from the pin and from the associated member. Means such as a head or stud are provided for retaining the members transversely with respect to the bracelet. The members may be of uniform thickness, the grooves being formed by the curvature of the sides of these members.

8 Claims, 5 Drawing Figures

METAL BRACELET IN THE FORM OF A BAND COMPRISED OF MEMBERS LINKED ONE WITH RESPECT TO THE OTHER

The present invention relates to a metal bracelet in the form of a band, comprised of members linked one with respect to each other by means of pins, such as a watch bracelet or a fancy bracelet.

It is known to manufacture metal bracelets comprised of members linked one to another, by means of solid members provided with holes in which connecting and pivoting pins are fitted. Drilling of the holes takes place by means of a bit. Now these holes have a very small diameter, whereas the members, when they extend over the entire width of the bracelet, are relatively long. Drilling of this type is a delicate operation under these conditions. The bit tends to bend and to be deflected, if not to break. Machining of this type is consequently difficult and expensive.

Attempts have already been made to produce connections without drilling and without pins. For example, in French Pat. No. 960 355, it was proposed to use split tubular members which are connected and linked one with respect to the other by means of clips, which are also constituted by split tubular members, fitted axially in the first split tubular members. A similar construction is also proposed in Swiss Pat. No. 410 495, in which the connecting members comprise a tongue at the end, which can be folded back in order to ensure lateral locking of the members. These constructions utilize tubular members cut from a tube obtained by wire-drawing. Now it is difficult and expensive to obtain sufficiently constant and accurate dimensions during wire-drawing. On the other hand it is difficult to obtain members having a solid appearance such as those used in high quality bracelets. Finally, bracelets of this type are difficult to lengthen or shorten by the addition or removal of members.

The present invention intends to obtain a metal bracelet comprised of members linked one with respect to the other by means of pins, i.e. in a conventional manner, making it possible to add or remove a member in a simple manner, but without it being necessary to drill the members, nor to fit the latter axially one in the other.

According to the present invention there is provided a metal bracelet in the form of a band, comprised of members linked one with respect to the other by means of pins, characterised in that it is comprised essentially of members only of a general U shape and of the same internal profile, arranged in at least two rows which are superimposed in a staggered manner and opposed, by the sides of the members, so that the members of the same row are engaged by their sides in the members of the other row, these sides comprising, on their inner face, a groove defining, with the similar groove of the opposite side of the adjacent member engaged in a staggered manner a passage for a pin of corresponding shape, the clearance between two adjacent members of the same row being less than the necessary movement of the member perpendicular to the pin in order to release it from the pin and from the associated member, means being provided for retaining the members transversely with respect to the bracelet.

Since the members are not drilled, they may be produced economically, i.e., by a method which is rapid and easy to master. The assembly of the bracelet takes place simply by vertical superimposition and engagement of the members. It is also quite possible to produce a bracelet constituted by several visible rows arranged in staggered manner, which is not the case with members fitted axially one in the other and which makes it possible to obtain an infinite variety of designs.

The members may be solid, of trapezoidal shape, with straight sides or of constant thickness, the grooves in this case being in the shape of an arc of a circle and constituted by the curvature of the sides.

By giving the sides an adequate shape, it is also possible to obtain bending of the bracelet in a preferred direction.

Embodiments of the present invention will now be described, by way of example, with reference to the accompanying drawings, in which.

Figure 1:
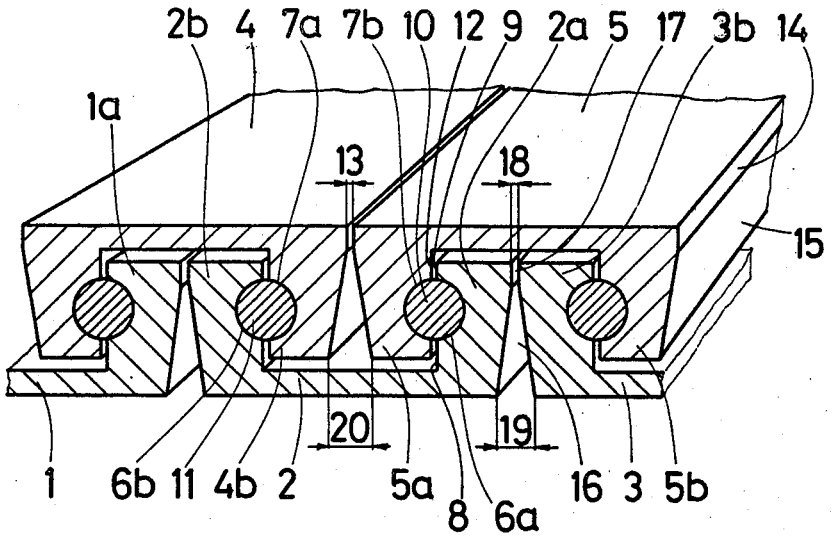
FIG. 1 is a view in section and perspective of a first embodiment.
Figure 2:
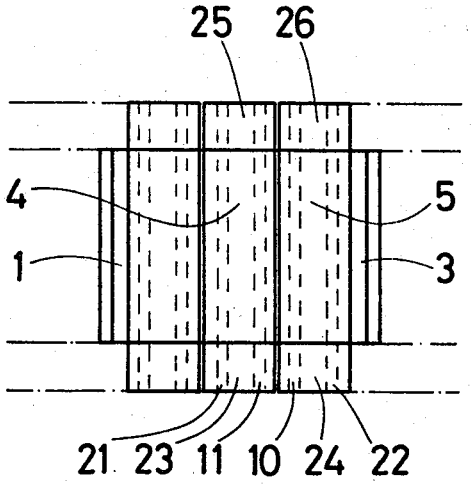
FIG. 2 is a plan view of part of the same bracelet.

The bracelet illustrated in FIGS. 1 and 2 is constituted essentially by a first row of metal members arranged side by side, such as 1,2,3, comprising a general U-shaped profile and of a second row of metal members arranged side by side such as 4 and 5, also of U shape, but inverted, arranged in a staggered manner relative to the members 1,2,3 of the first row. All the members have the same internal profile, in this case approximately rectangular and are engaged one in the other by their sides. Thus, the sides **1*a* and 2*b* of the members 1 and 2 are engaged inside the member 4, whereas the sides 4*b* and 5*a* of the members 4 and 5 are engaged in the member 2**.

On their inner face, the sides of the members, for example the sides **2*a* and 5*a*, comprise grooves 6*a*, respectively 7*b*, whereof the section is in the shape of an arc of a circle slightly less than 180°, the inner face of the sides comprising a slight recess between its lower rectilinear part 8 and its upper rectilinear part 9. The two grooves 6*a* and 7*b* together define a passage of circular section for a cylindrical pin 10 of the same radius as the grooves 6*a* and 7*b*. In an identical manner, the sides 2*b* and 4*b* comprise grooves 6*b* and 7*a* defining a housing of circular section for a cylindrical pin 11 and so on for the other members. In this embodiment, it may be pointed out that the lower part 8 of the side of the lower member is aligned with the flat upper part 12. The clearance 13 between two adjacent members such as 4 and 5 completely prevents any disconnection of the members which are thus locked by the pins 10 and 11. However, this clearance 13 allows a slight rotation of the members one with respect to the other, i.e. slight bending of the bracelet. In fact, locking occurs as soon as the clearance 13 is less than the deflection of the arc subtended by the plane perpendicular to the plane of the bracelet passing through the end of the outer edge of the groove 6*a* for example. Externally, the sides of the upper members 4 and 5 comprise a first plane face 14 perpendicular to the plane of the member and defining the clearance 13, followed by a second plane face 15 which is oblique and convergent, giving the member a trapezoidal profile, the clearance between two adjacent members 4 and 5 increasing progressively towards the ends of the sides. The members of the lower row 1,2,3 have the reverse profile, i.e. a first divergent plane face 16 followed by a narrow plane face 17 perpendicular to the plane of the member and defining the clearance 18 between two members of the lower row. The result of the difference of the profiles of the members of two rows is that the "bending" of the bracelet in order to comprise a concavity towards the bottom of the drawing, is greater, on account of the relatively great clearances 19 and 20, than in the other direction where it is limited by the two very small clearances 13 and 18. In fact, the clearance 13** could be reduced to zero, but such a measure would require expensive precision of the other dimensions.

FIG. 2 shows part of this same bracelet in plan view. The pins 10,11,21 and 22 are fixed by their ends in studs 23,24,25 and 26, of the same profile as the members 4 and 5. The pins may be fixed by riveting or welding. The studs 23 to 26 retain the members of the bracelet transversely.

Figure 3:
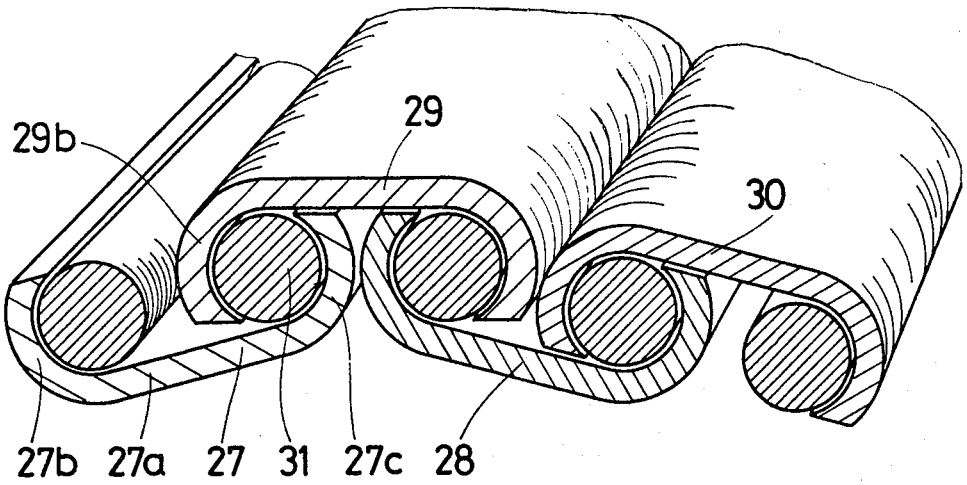
FIG. 3 is a view in section and perspective of a second embodiment.
Figure 4:
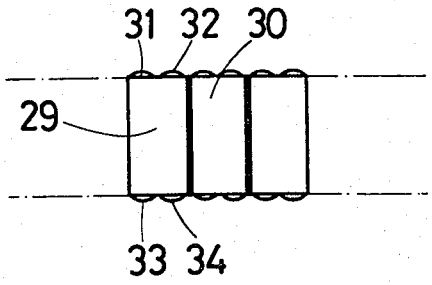
FIG. 4 is a plan view of part of the bracelet shown in FIG. 3.

A second embodiment is illustrated in FIGS. 3 and 4. In this embodiment, the members of the bracelet are identical and of uniform thickness. They comprise a flat part **27*a* continuing in two sides 27*b* and 27*c* curved in the shape of an arc of a circle in order to form housings of cylindrical surface similar to the grooves 6*a* and 7*b* of the first embodiment. The sides, such as 27*c* and 29*b* of two members engaged in staggered arrangement such as 27 and 29 thus define a cylindrical housing for a cylindrical pin 31. The arc of the sides of the members and the clearance between two adjacent members of the same row such as 27 and 28 are such that the members are locked with respect to each other. In this case, the bending of the bracelet is limited by the value of the arc of the sides whereof the end abuts against the base of another member. It is thus also possible to have preferential bending by choosing sides of different lengths, more precisely with different arcs, for the two rows. The ends of the pins could also be fixed in terminal studs as in the first embodiment, but according to a simplified embodiment, the pins are provided with a head 33,34 at one of their ends and riveted at their other ends 31,32 as shown in FIG. 4**.

Figure 5:
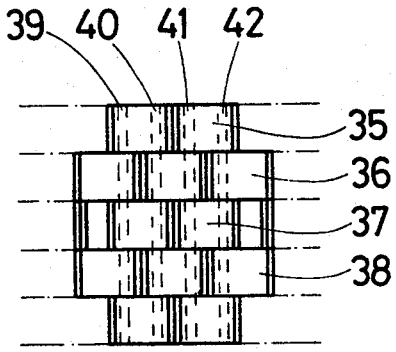
FIG. 5 is a plan view of part of a bracelet constituted by several pairs of rows.

Apart from these two typical embodiments, a man skilled in the art will immediately recognise the infinite number of possible variations. By way of example, FIG. 5 shows the possibility of having several pairs of rows 35, 36,37,38, arranged side by side and in staggered manner, the members of each pair of rows being assembled as shown in FIG. 1 an the pairs of rows also being assembled with respect to each other by the same pins 39,40,41,42.

Instead of being fixed by riveting or welding, the pins may be screwed into terminal studs or may be made in two parts, one comprising a screwthreaded hole and the other being constituted by a screw. It is even possible to use pins comprising springs, such as those used for fixing a watch bracelet to a watch, by using terminal studs or plates connected to each other or quite simply a U-shaped plate.

According to a simplified variation of the embodiment shown in FIG. 1, the sides of the sectional members have a uniform thickness, with the exception of the cylindrical groove and they are simply bent in order to be slightly divergent for the members of the lower row and slightly convergent for the members of the upper row.

The grooves are not necessarily of circular section, but may have a section of different shape, for example oval, oblong, or polygonal, the linking of the members with respect to each other being ensured by an adequate clearance.

What is claimed is:

1. A metal bracelet in the form of a band, comprised of members linked one with respect to the other by means of pins, and comprised essentially of members, each having a generally U-shaped configuration of the same internal profile, and arranged in at least two rows which are superimposed in a staggered manner and opposed, by the sides of the members, so that the members of the same row are engaged by their sides with the members of the other row, these sides comprising, on their inner face, a curved surface defining, with a similar curved surface of the opposite side of the adjacent member engaged in a staggered manner, a passage for a pin of corresponding shape, the clearance between the two adjacent members of the same row being less then the distance necessary to separate one of the members from the pin and from its associated member when moving said one member away from said pin toward said associated member, and means on said pin retaining the members transversely with respect to the bracelet.

2. The bracelet according to claim 1, wherein the members have a prismatic outer shape and the members of one of the rows comprise sides which widen out from the base to their end, whereas the members of the other row have sides which become narrower from the base to their end, whereby bending of the bracelet is substantially greater in one direction than in the other.

3. The bracelet according to claim 1, wherein the members have a prismatic outer shape of a trapezoidal section and the sides of the members of one of the rows are divergent, whereas the sides of the members of the other row are convergent, so that the binding of the bracelet is substantially greater in one direction than in the opposite direction.

4. The bracelet according to claim 1, wherein the members have a uniform thickness, and the curved surfaces are in the shape of an arc of a circle, being constituted by the curvature of their sides.

5. The bracelet according to claim 1, comprising an odd number of pairs of superimposed rows arranged side by side in a staggered manner.

6. The bracelet according to claim 1, wherein the pins are comprised of keeper pins riveted or welded at their ends.

7. The bracelet according to claim 1, wherein the pins are riveted or welded in pairs, at each end, in studs.

8. The bracelet according to claim 1 wherein the curved surfaces are grooves provided in the opposing faces of the adjacent members.

* * * * *